United States Patent [19]

Grabarek et al.

[11] Patent Number: 4,590,862

[45] Date of Patent: May 27, 1986

[54] PROJECTILE PUSHER-TYPE DISCARDING SABOT

[75] Inventors: Chester Grabarek, Aberdeen, Md.; Dave L. Collis, Socorro, N. Mex.

[73] Assignee: The United States of America as represented by the Secretary of the Army, Washington, D.C.

[21] Appl. No.: 497,448

[22] Filed: May 23, 1983

[51] Int. Cl.[4] ..... F42B 13/16

[52] U.S. Cl. ..... 102/522; 102/532; 102/703

[58] Field of Search ..... 102/520–523, 102/532, 448, 703

[56] References Cited

U.S. PATENT DOCUMENTS

| | | | |
|---|---|---|---|
| 126,615 | 5/1872 | Wood | 102/532 |
| 1,794,141 | 2/1931 | Bloch-Jorgensen | 102/520 |
| 2,306,140 | 12/1942 | Reed | 102/522 |
| 3,089,388 | 5/1963 | Webster et al. | 102/522 |
| 3,762,332 | 10/1973 | Witherspoon et al. | 102/523 |
| 3,802,345 | 4/1974 | La Costa | 102/522 |
| 3,948,184 | 4/1976 | Pierre | 102/522 |
| 4,043,269 | 8/1977 | Ambrosini | 102/522 |

FOREIGN PATENT DOCUMENTS

| | | | |
|---|---|---|---|
| 913460 | 10/1972 | Canada | 102/520 |

*Primary Examiner*—Harold J. Tudor

*Attorney, Agent, or Firm*—Anthony T. Lane; Robert P. Gibson; Michael C. Sachs

[57] ABSTRACT

A pusher-type sabot for the launching of sub-caliber ballistic projectiles whose dimensions are significantly less than the gun bore diameter from which they are launched, the pusher-type sabot having a pusher plate and bore rider, segmented such that the trajectory imparted upon the pusher plate and bore rider segment is deviant from that of the sub-caliber ballistic projectile upon leaving the gun bore.

5 Claims, 5 Drawing Figures

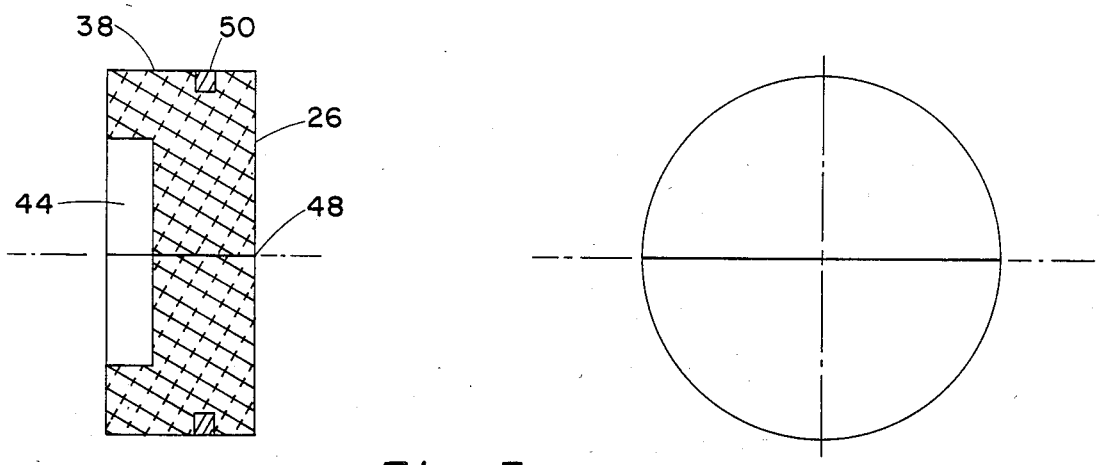
Fig. 3-a
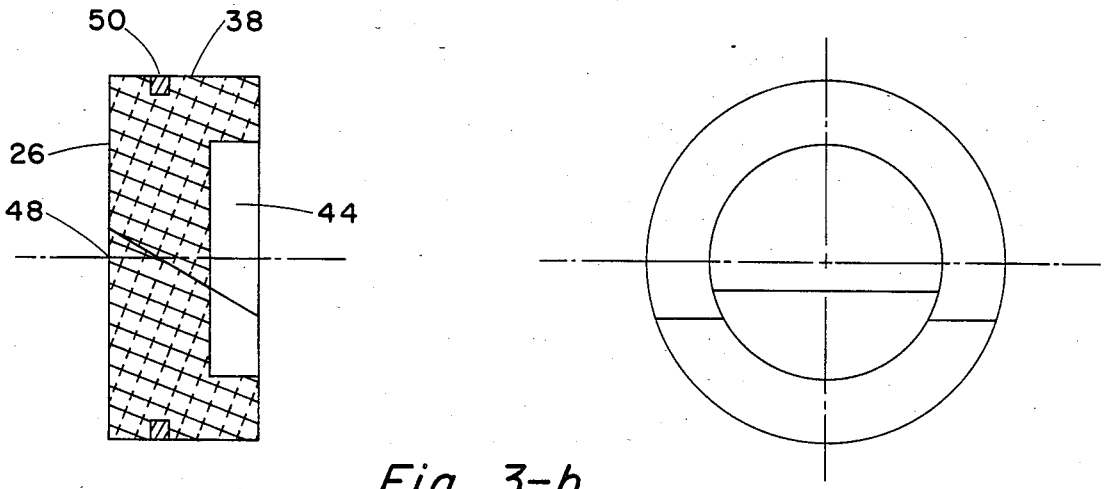
Fig. 3-b
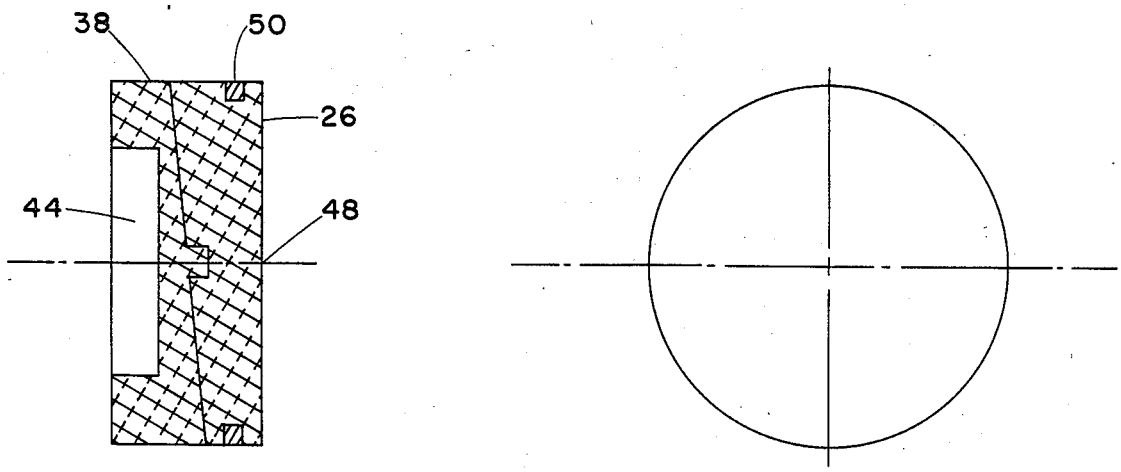
Fig. 3-c

PROJECTILE PUSHER-TYPE DISCARDING SABOT

GOVERNMENTAL INTEREST

The invention described herein may be manufactured, used and licensed by or for the government for governmental purposes without the payment to us of any royalties thereon.

FIELD OF THE INVENTION

This invention relates to an apparatus for the launching of sub-caliber, ballistic projectiles whose dimensions are significantly less than the gunbore diameter from which they are fired or launched, and more particularly a pusher-type discarding sabot.

BACKGROUND OF THE INVENTION

Grips or sabots are typically used in the launching or firing of sub-caliber, ballistic projectiles, which are projectiles having a diameter significantly less than the inner diameter of the gun bore through which the projectile is fired. Sabots are used in actual weapon systems, such as the armor piercing discarding sabot tank rounds (APDS). However, sabots also have a general application for test firings in order to launch both small scale and large scale projectiles from guns of bore diameter ranging from 5.56 mm. through 180 mm. The test firing of projectiles is an ongoing procedure for the purpose of obtaining experimental terminal ballistic performance data on such projectiles with respect to different arrangements and proportions of target orientation. Such testing requires the accurate measurement of the target cavity hole size plus a full examination of the characteristics of the target and target ejecta when perforation is achieved by the projectile.

Sabots, typically have been of three designs. The first design is a pull-type design where the projectile mass is carried rearwardly of the sabot. In such configuration, the projectile is pulled by the sabot from the gun bore by the expanding gases. The second design of a sabot is the pusher-type sabot wherein the projectile is carried forwardly of the sabot and is pushed from the gun bore by the action of the expanding gases upon the sabot. The third design is a push-pull type sabot, wherein the sabot is located at some point axially along the length of the projectile. The selection of any of the aforementioned methods of sabot for use with a given projectile is usually determined by the economic balance of the application and the production volume and tooling cost of the sabot. The pusher-type sabot from an economic standpoint is the most economical and is widely used for launching sub-caliber ballistic projectiles for test purposes.

Previous designs of pusher-type sabots have employed a homogeneous steel pusher plate positioned behind the projectile. The homogeneous pusher plate absorbs the forces associated with the initial movement of the assembly in the gun barrel by the expanding gases and thus pushes the projectile from the gun bore. A drawback of the homogeneous pusher plates of the type typically used is that when the projectile and pusher plate exit from the gun bore, the pusher plate, while separating from the projectile, in many instances would follow the projectile to the target and impact the target proximate to the penetration made by the projectile. When this occurs, the value of the test is obviously negated since the terminal ballistic performance data, including the target cavity and hole size, and characteristics of target ejecta are distorted as a result of the sabot contacting the target.

OBJECTS OF THE INVENTION

An object of the present invention is to provide a novel sabot for use with sub-caliber ballistic projectiles, having a different trajectory than the projectile.

Another object of the present invention is to provide a novel sabot for use with sub-caliber ballistic projectiles incapable of target impact.

Yet another object of the present invention is to provide a novel sabot for use with sub-caliber ballistic projectiles directed to the side upon exiting the gun bore.

A further object of the present invention is to provide a novel sabot for use with sub-caliber ballistic projectiles of improved time/economic advantages.

SUMMARY OF THE INVENTION

These and other objects of the present invention are achieved by a pusher-type sabot, comprised of multiple axial segmented elements having in-bore symmetry and dynamic stability for in-bore guidance of a projectile, but which separate and become aerodynamically unstable after exiting the gun bore such that the multiple axially segmented elements are imparted with a trajectory different than that of the projectile.

BRIEF DESCRIPTION OF THE DRAWINGS

FIGS. 3-*a*, 3-*b*, and 3-*c* are cross-sectional views of the pusher-plate sabot depicting various means for axially segmenting the element.

DETAILED DESCRIPTION OF THE DRAWINGS

Figure 1:
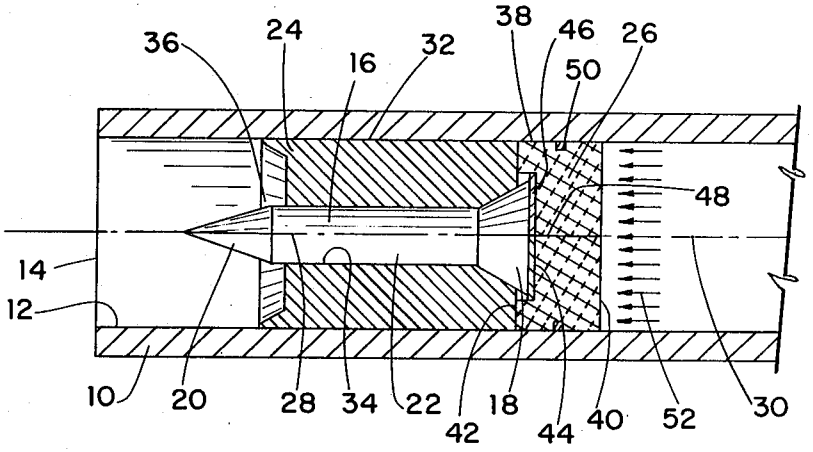
FIG. 1 is a cross-sectional side elevation view of a projectile and associated sabot within a gun bore.

Referring to FIG. 1 there is illustrated a gun bore 10 having an inner diameter 12 and bore opening 14. Displaced within gun bore 10 is a projectile 16, and as depicted in FIG. 1, is a flare-stabilized type projectile having a truncated conical tail portion 18, a conical nose 20, and a cylindrical body portion 22. Although a flare-stabilized projectile 16 is depicted in FIG. 1, it is understood that the present invention has application to both finned or spin-stabilized projectiles. The projectile 16 is maintained in position within gun bore 10 by means of a bore rider 24 and a pusher plate 26 such that the longitudinal axis 28 of projectile 16 coincides with the longitudinal axis 30 of gun bore 10 during the time in which projectile 16 is within gun bore 10.

Bore rider 24 is a cylinder whose outer diameter 32 is equal to the inner diameter 12 of gun bore 10. The diameter of the annulus 34 of bore rider 24 is equal the diameter of center body portion 22 of projectile 16. Bore rider 24 is located approximate to nose 20 of projectile 16, such that the annulus 34 of bore rider 24 is in friction contact with body portion 22. This friction contact maintains bore rider 24 in position with relationship to projectile 16, when projectile 16 is subjected to acceleration through gun bore 10. Bore rider 24 which could be polyproplux is segmented at its diameter so as to form two equal C-shaped elements when not confined to its annular form in gun bore 10.

Displaced rearwardly of flare-stabilizer 18 of projectile 16 is pusher plate 26 which could be polyproplux or aluminum. Pusher plate 26 comprises a radially segmented disc having an outer diameter 38 equal to the inner diameter 12 of gun bore 10. Pusher plate 26 comprises a rear-face 40 and front-face 42, said front-face 42 having a circular cavity 44 whose circumference is approximatey equal to the circumference of the base of flare stabilizer 18. Positioned in circular cavity 44 is a shock absorbant disc 46 which could be steel whose circumference approximates the circumference or circular cavity 44. In this configuration, the base of flair stabilizer 18 fits within circular cavity 44 and is in intimate contact with shock absorbing disc 46 such that shock absorbing disc 46 absorbs the initial instantaneous accelerating force of the propellant gases 52. Pusher plate 26 is axially segmented along its center line 48. Pusher plate 26 has at its circumference obturator 50 when could be polyproplux which imparts a spin stabilization to projectile 16 if required by causing pusher plate 26 to rotate within gun bore 10 due to the rifling of gun bore 10 as pusher plate 26 is displaced along gun bore 10 towards gun bore opening 14 by propellant gases 52.

Referring to FIG. 3-*a*, there is shown a cross-sectional view of pusher plate 26 wherein pusher plate 26 is segmented in a horizontal plane at its center line.

Referring to FIG. 3-*b*, there is shown a cross-sectional view of pusher plate 26 wherein pusher plate 26 is segmented by a non-horizontal plane intersecting the center line. The object of segmenting pusher plate 26 is to insure that upon exiting the gun bore 10, its trajectory will be imparted to the segmented portions of pusher plate 26 such that they will not follow a projectile 16 to the target.

Referring to FIG. 3-*c*, there is shown a cross-sectional view of pusher plate 26 wherein pusher plate 26 is segmented transversly and circumferentially with the same objective as described in reference to FIGS. 3-*a* and 3-*b*.

Figure 2:
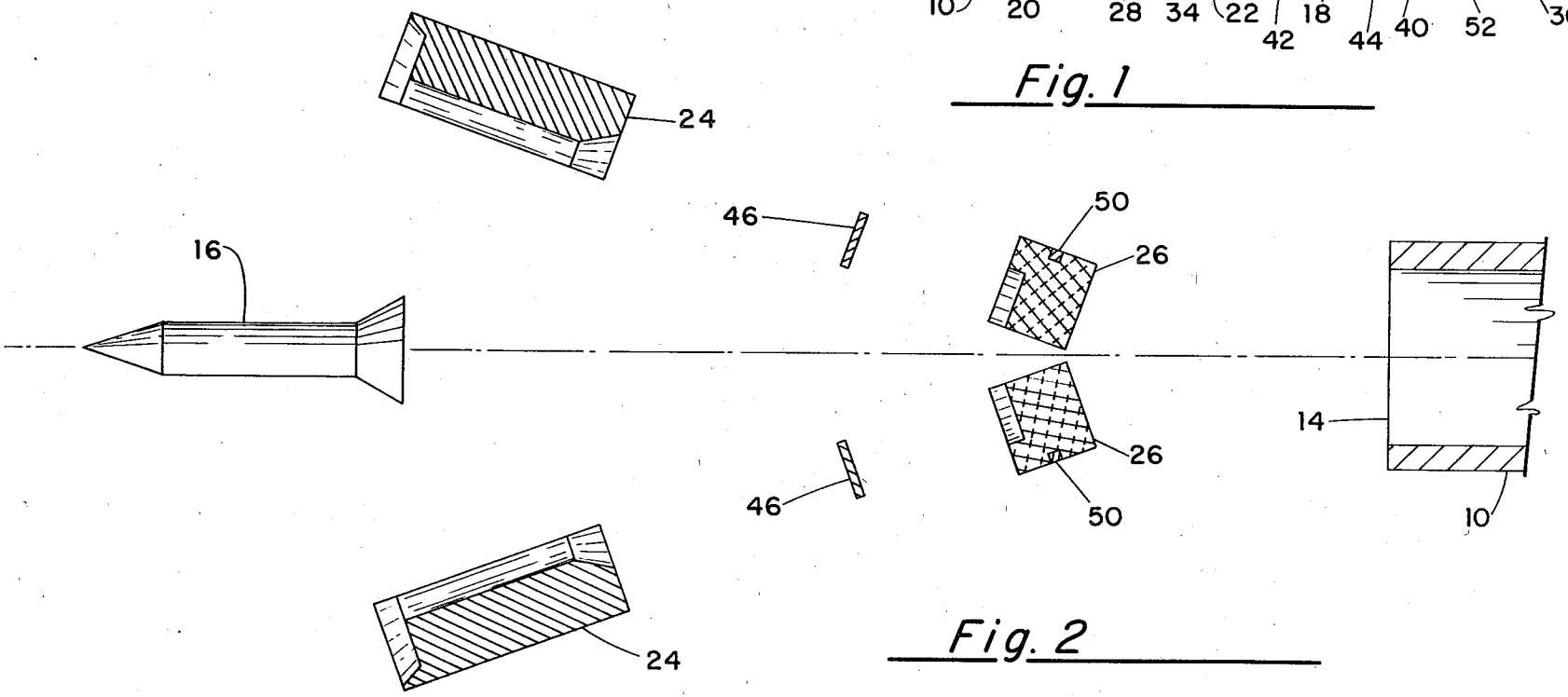
FIG. 2 is a side elevational view of the projectile after firing depicting the displacement trajectories of the sabot.

Referring to FIG. 2, there is shown a side elevation view depicting the different trajectories imparted to the pusher plate 26, the shock absorbent disc 46, and bore rider 24. Each of the aforementioned elements provide for dynamic stability and in-bore symmetry, but due to their axial segmentation, they each become aerodynamically unstable upon leaving the gun bore and each therefore acquires a separate trajectory from that of the projectile in free flight.

We claim:

1. A gun system including a gun barrel for launching single sub-caliber projectiles of varying caliber and geometrical design which have diameter significantly smaller tha the bore diameter of said gun barrel, including projectile positioning and pushing elements of such distinctive aerodynamic characteristics that the elements are incapable essentially of following the same flight trajectory as the projectile to avoid overstriking of a test target were said elements to strike the same target spot as the projectile, the said projectile being of the flare-stabilized type having a truncated conical tail portion and a cylindrical body said projectile positioning and pushing elements comprising a plastic polyproplux bore rider element arranged as a cylinder of diameter equal to the inside bore diameter of said gun, said bore rider having a hollowed out cavity arranged symmetrically coaxial with the longitudinal axis of said gun barrel of geometrical shape adapted to conform to and accept the contour of said projectile for holding said projectile therein, the bore rider not covering the front of the projectile leaving the projectile tip exposed, there being a recessed countersunk bore in the front of said bore rider subsantially across the full face of said bore rider, a pusher element arranged as an aluminum cylinder of diameter equal to the inside bore diameter of said gun, there being a recessed groove in the circumference of said pusher element to receive an obturator, said obturator adapted as a plastic ring and used to seal said pusher element against blow-by gases, there being a round recess at the front end of said pusher element adapted for receiving the aft end of said projectile; and a steel disc for absorbing shock, placed in said recess between said projectile aft end and said pusher element; said projectile being loaded into said bore rider cavity, and fired by expanding gases behind said pusher element, which element is positioned behind said bore rider and projectile combination; each of said bore rider, disc, and pusher elements being comprised of two sections which are formed by cutting them in a longitudinal plane which includes the common longitudinal axis of the said gun barrel and projectile; the said bore rider, disc, and pusher element sections not following the trajectory of said projectile when launched because of unsymmetrical aerodynamic drag thereon as compared with that of said projectile.

2. The system of claim 1 wherein the bore rider has a countersunk hole in its frontal area, for weight reductior of said bore rider.

3. The system of claim 1 wherein the bore of said gun barrel is rifled, which causes spinning when said obturator follows said rifling pattern within as it advances along with the pusher, rider, and projectile through the barrel.

4. A gun system including a gun barrel for launching single sub-caliber projectiles of varying caliber and geometrical design which have diameter significantly smaller than the bore diameter of said gun barrel, including projectile positioning and pushing elements of such distinctive aerodynamic characteristics that the elements are incapable essentially of following the same flight trajectory as the projectile to avoid overstriking of a test target were said elements to strike the same target spot as the projectile, there being a spin imparted to said projectile as it advances along the gun barrel said barrel being rifled, said projectile positioning and pushing elements compising a plastic bore rider element arranged as a cylinder of diameter equal to the inside bore diameter of said gun, there being a recessed countersunk bore in the front of said bore rider substantially across the full face of said bore rider, said bore rider having a hollowed out cavity arranged symmetrically, coaxial with the longitudinal axis of said gun barrel of geometrical shape adapted to conform to the contour of said projectile for receiving said projectile therein, a pusher element arranged as an aluminum cylinder of diameter equal to the inside bore diameter of said gun, there being a recessed groove in the circumference of said pusher element to receive an obturator, said obturator adapted as a plastic ring and used to seal said pusher element against blow-by gases, there being a round recess at the front end of said pusher element adapted for receiving the aft end of said projectile; and a steel disc for absorbing shock, placed in said recess between said projectile aft end and said pusher element; said projectile being loaded into said bore rider cavity, and fired by expanding gases behind said pusher element, which element is positioned behind said bore rider and projectile combination; each of said bore rider, disc, and pusher elements being comprised of two sections which are formed by cutting them in a longitudinal plane which includes the common longitudinal axis of the said gun barrel and projectile; the said bore rider, disc, and pusher element sections not following the trajectory of said projectile when launched because of unsymmetrical aerodynamic drag thereon as compared with that of said projectile.

5. A gun system including a gun barrel for launching single sub-caliber projectiles of varying caliber and geometrical design which have diameter significantly smaller than the bore diameter of said gun barrel, including projectile positioning and pushing elements of such distinctive aerodynamic characteristics that the elements are incapable essentially of following the same flight trajectory as the projectile to avoid overstriking of a test target were said elements to strike the same target spot as the projectile, there being a spin imparted to said projectile as it advances along the gun barrel, said barrel being rifled, the said projectile being of flare-stabilized type having a truncated conical tail portion, and a cylindrical body, said projectile positioning and pushing elements comprising a plastic bore rider element arranged as a cylinder of diamter equal to the inside bore diameter of said gun, there being a recessed countersunk bore in the front of said bore rider substantially across the full face of said bore rider, said bore rider having a hollowed out cavity arranged symmetrically, coaxial with the longitudinal axis of said gun barrel, the geometrical shape of said cavity conforming to the contour of said projectile, to receive said projectile therein, a pusher element arranged as an aluminum cylinder of diameter equal to the inside bore diameter of said gun, there being a recessed groove in the circumference of said pusher element to receive an obturator, said obturator adapted as a plastic ring and used to seal said pusher element against blow-by gases, there being a round recess at the front end of said pusher element adapted for receiving the aft end of said projectile; and a steel disc for absorbing shock, placed in said recess between said projectile aft end and said pusher element; said projectile being loaded into said bore rider cavity, and fired by expanding gases behind said pusher element, which element is positioned behind said bore rider and projectile combination; each of said bore rider, disc, and pusher elements being comprised of two sections which are formed by cutting them in a longitudinal plane which includes the common longitudinal axis of the said gun barrel and projectile; the said bore rider, disc, and pusher element sections not following the trajectory of said projectile when launched because of unsymmetrical aerodynamic drag thereon as compared with that of said projectile.

* * * * *